US012624874B2

(12) United States Patent
Shen et al.

(10) Patent No.: US 12,624,874 B2
(45) Date of Patent: May 12, 2026

(54) HEAT PUMP SYSTEM AND CONTROL METHOD THEREOF

(71) Applicant: Carrier Corporation, Palm Beach Gardens, FL (US)

(72) Inventors: Guangyu Shen, Shanghai (CN); Guang Zhang, Shanghai (CN); Hui Zhai, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 155 days.

(21) Appl. No.: 18/480,614

(22) Filed: Oct. 4, 2023

(65) Prior Publication Data

US 2025/0102208 A1 Mar. 27, 2025

(30) Foreign Application Priority Data

Sep. 22, 2023 (EP) ..... 23199226

(51) Int. Cl.
*F25B 47/02* (2006.01)
*F25B 5/02* (2006.01)
*F25B 41/34* (2021.01)

(52) U.S. Cl.
CPC ..... *F25B 47/027* (2013.01); *F25B 5/02* (2013.01); *F25B 41/34* (2021.01); *F25B 2313/021* (2013.01)

(58) Field of Classification Search
CPC ..... F25B 47/027; F25B 47/025; F25B 47/02; F25B 41/34; F25B 41/345; F25B 5/02; F25B 13/00; F25B 2313/021
See application file for complete search history.

(56) References Cited

U.S. PATENT DOCUMENTS 4,628,706 A 12/1986 Neudorfer
5,165,250 A 11/1992 Nagatomo et al.
(Continued)

FOREIGN PATENT DOCUMENTS

CN 109539620 A 3/2019
DE 102012004094 B3 6/2013
(Continued)

OTHER PUBLICATIONS

Extended European Search Report received for EP Application No. 23199226.4, mailed on Feb. 12, 2024, 8 Pages.

*Primary Examiner* — Miguel A Diaz
(74) *Attorney, Agent, or Firm* — Drew Folgmann

(57) ABSTRACT

The heat pump system comprises an indoor unit and an outdoor unit communicated through a refrigerant pipeline. The outdoor unit comprises a compressor, a first heat exchanger, a first throttling device, and a change-over valve. The indoor unit comprises a second heat exchanger. A heat storage unit is arranged on the refrigerant gas-phase pipeline between the indoor unit and the outdoor unit, the heat storage unit comprising a first branch and a second branch arranged in parallel. The first branch is provided with a heat storage heat exchanger and a second throttling device, and the second branch is provided with a control valve device capable of cutting off refrigerant flowing through the second branch in a controlled manner. The heat pump system can operate in a cooling mode, a heating mode, a heat storage and heating mode, and a defrosting mode.

18 Claims, 1 Drawing Sheet

(56) References Cited

U.S. PATENT DOCUMENTS

| | | | | |
|---|---|---|---|---|
| 5,497,629 | A * | 3/1996 | Rafalovich | F25B 29/003 62/332 |
| 5,680,898 | A | 10/1997 | Rafalovich et al. | |
| 5,755,104 | A | 5/1998 | Rafalovich et al. | |
| 8,516,847 | B2 | 8/2013 | Koh et al. | |
| 8,667,804 | B2 | 3/2014 | Koh et al. | |
| 10,267,569 | B2 | 4/2019 | Altman et al. | |
| 10,539,335 | B2 | 1/2020 | Yasuo et al. | |
| 11,175,082 | B2 | 11/2021 | Tanaka | |
| 11,193,702 | B2 | 12/2021 | Bissell et al. | |
| 2009/0282854 | A1 * | 11/2009 | Matsuoka | F24F 3/001 62/335 |
| 2019/0226735 | A1 * | 7/2019 | Bissell | F25B 47/025 |
| 2019/0383713 | A1 * | 12/2019 | Haack | F25B 5/02 |

FOREIGN PATENT DOCUMENTS

| | | | |
|---|---|---|---|
| EP | 2040009 | A1 | 3/2009 |
| JP | 2009287903 | A | 12/2009 |
| JP | 5287820 | B2 | 9/2013 |
| WO | 9741398 | A1 | 11/1997 |
| WO | 2012032680 | A1 | 3/2012 |
| WO | 2014057454 | A1 | 4/2014 |

* cited by examiner

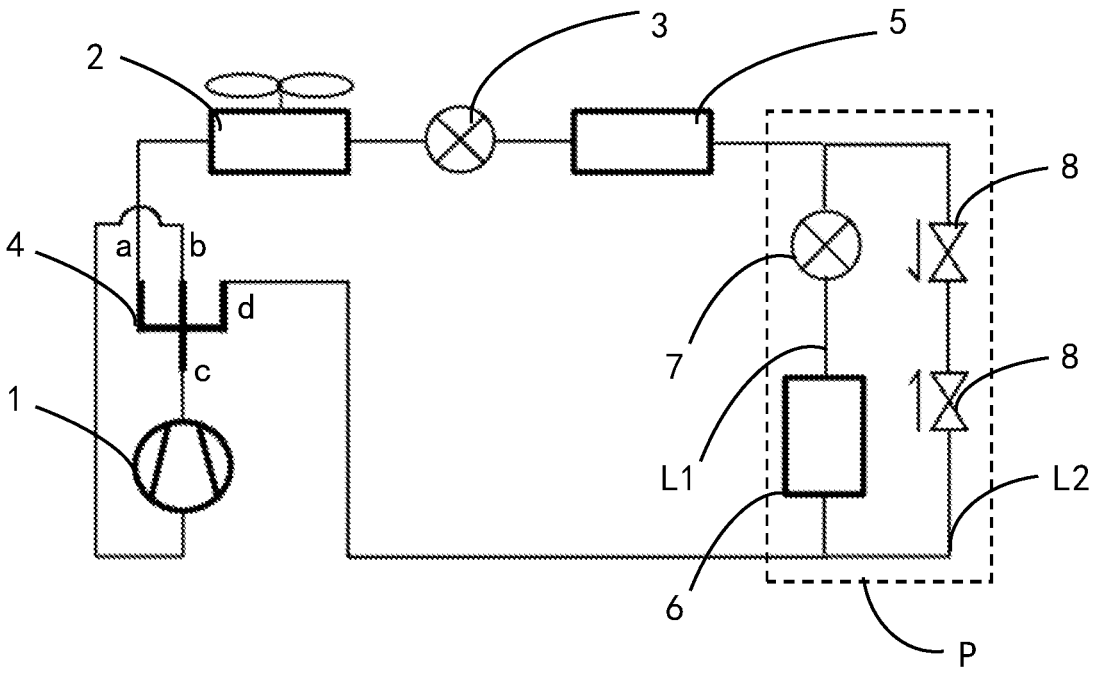
2
3
5
8
4
a
b
d
c
7
8
1
L1
L2
6
P

HEAT PUMP SYSTEM AND CONTROL METHOD THEREOF

CROSS REFERENCE TO RELATED APPLICATIONS

This application claims priority to European Patent Application No. 23199226.4 filed on Sep. 22, 2023, which is incorporated by reference herein in its entirety.

FIELD OF THE INVENTION

The present application relates to the field of heat pumps, and in particular to a heat pump system and a control method thereof.

BACKGROUND OF THE INVENTION

In order to improve the comfort of air conditioning systems, common air conditioning systems have a cooling mode. Air conditioning systems with cooling and heating modes are also known as heat pump systems. However, in the heating mode, the outdoor heat exchanger, when placed in a low-temperature and high-humidity environment, would easily get frosted. Generally, heat pump systems have a defrosting mode, where the high-temperature and overheated refrigerant at the compressor outlet is directly delivered to the outdoor heat exchanger to quickly melt the frost. In the defrosting mode, as the high-temperature refrigerant is delivered to the outdoor heat exchanger, this will cause the indoor heat exchanger not only to stop heating, but also to absorb heat from inside the room.

In the prior art, heat storage heat exchangers are sometimes utilized to store heat in the heating mode and use the heat stored in the heat storage heat exchanger to defrost in the defrosting mode. This type of device usually includes two sets of change-over valves and several check valves. These devices are generally unable to provide indoor heating during the defrosting mode, or they can achieve continuous heating yet with significantly increased system costs, which makes it difficult to put on the market. In addition, heat storage heat exchangers are usually installed on the inner sides of the outdoor units of air conditioning systems, which increases the design difficulty of outdoor units.

SUMMARY OF THE INVENTION

According to a first aspect of the present invention, a heat pump system is provided, comprising: an indoor unit and an outdoor unit communicated through a refrigerant pipeline, wherein the outdoor unit comprises a compressor, a first heat exchanger, a first throttling device, and a change-over valve, and the indoor unit comprises a second heat exchanger, where the refrigerant pipeline has a refrigerant gas-phase pipeline and a refrigerant liquid-phase pipeline, wherein a heat storage unit is arranged on the refrigerant gas-phase pipeline between the indoor unit and the outdoor unit, the heat storage unit comprising a first branch and a second branch arranged in parallel, wherein the first branch is provided with a heat storage heat exchanger and a second throttling device, and the second branch is provided with a control valve device capable of cutting off refrigerant flowing through the second branch in a controlled manner, wherein, the heat pump system is capable of operating in a cooling mode, a heating mode, a heat storage and heating mode, and a defrosting mode, where, in the cooling mode, the second throttling device is turned off, so that no refrigerant passes through the heat storage heat exchanger, and the control valve device is turned on, so that the refrigerant flows from the second heat exchanger of the indoor unit to the change-over valve of the outdoor unit through the second branch, and then enters a suction port of the compressor;

in the heating mode, the second throttling device is turned on with a tiny opening, where the tiny opening is an opening at which a small amount of refrigerant flows through the heat storage heat exchanger to maintain its flowing state, and the control valve device is turned on to allow the refrigerant to flow from the change-over valve of the outdoor unit to the second heat exchanger of the indoor unit through the second branch;

in the heat storage and heating mode, the second throttling device is fully turned on with the first throttling device playing a throttling role to store heat in the heat storage heat exchanger, and the control valve device is turned off, so that no refrigerant passes through the second branch; or the second throttling device is partially turned on to allow at least a portion of the refrigerant to flow through the heat storage heat exchanger, and the control valve device is turned on to allow most of the refrigerant to pass through the second branch; and in the defrosting mode, the first throttling device is fully turned on with the second throttling device playing a throttling role to allow refrigerant to flow through the heat storage heat exchanger to absorb heat for evaporation, and the control valve device is turned off, so that no refrigerant passes through the second branch.

Optionally, in an embodiment of the heat pump system, the heat storage unit is detachably installed on the refrigerant gas-phase pipeline between the indoor unit and the outdoor unit.

Optionally, in an embodiment of the heat pump system, the heat storage unit is arranged on the refrigerant gas-phase pipeline between the second heat exchanger and the change-over valve.

Optionally, in an embodiment of the heat pump system, the control valve device comprises a first solenoid valve and a second solenoid valve connected in series, where the first solenoid valve and the second solenoid valve cut off the refrigerant passing through the second branch from opposite directions.

Optionally, in an embodiment of the heat pump system, the control valve device is a bidirectional cutoff solenoid valve or an electric ball valve.

Optionally, in an embodiment of the heat pump system, the heat storage heat exchanger is a phase change heat exchanger.

Optionally, in an embodiment of the heat pump system, the first throttling device and the second throttling device are electronic expansion valves.

According to a second aspect of the present invention, a control method for a heat pump system is further provided, the heat pump system comprising an indoor unit and an outdoor unit communicated through a refrigerant pipeline, wherein the outdoor unit comprises a compressor, a first heat exchanger, a first throttling device, and a change-over valve, and the indoor unit comprises a second heat exchanger, and wherein the refrigerant pipeline has a refrigerant gas-phase pipeline and a refrigerant liquid-phase pipeline, wherein a heat storage unit is arranged on the refrigerant gas-phase pipeline between the indoor unit and the outdoor unit, the heat storage unit comprising a first branch and a second branch arranged in parallel, wherein the first branch is provided with a heat storage heat exchanger and a second throttling device, and the second branch is provided with a control valve device capable of cutting off refrigerant flowing through the second branch in a controlled manner, turning off the second throttling device in a cooling mode, so that no refrigerant passes through the heat storage heat exchanger, and turning on the control valve device to allow the refrigerant to flow from the second heat exchanger of the indoor unit to the change-over valve of the outdoor unit through the second branch, and then enter a suction port of the compressor;

turning on the second throttling device with a tiny opening in a heating mode, where the tiny opening is an opening at which a small amount of refrigerant flows through the heat storage heat exchanger to maintain its flowing state, and turning on the control valve device to allow the refrigerant to flow from the change-over valve of the outdoor unit to the second heat exchanger of the indoor unit through the second branch;

fully turning on the second throttling device with the first throttling device playing a throttling role in a heat storage and heating mode to store heat in the heat storage heat exchanger, and turning off the control valve device, so that no refrigerant passes through the second branch; or partially turning on the second throttling device to allow at least a portion of the refrigerant to flow through the heat storage heat exchanger, and turning on the control valve device to allow most of the refrigerant to pass through the second branch; and fully turning on the first throttling device with the second throttling device playing a throttling role in the defrosting mode to allow refrigerant to flow through the heat storage heat exchanger to absorb heat for evaporation, and turning off the control valve device so that no refrigerant passes through the second branch.

Optionally, in an embodiment of the control method, the heat storage unit is detachably installed on the refrigerant gas-phase pipeline between the indoor unit and the outdoor unit.

Optionally, in an embodiment of the control method, the method further includes arranging the first branch and the second branch in parallel in the refrigerant gas-phase pipeline between the change-over valve and the second heat exchanger.

The system and method according to the embodiments of the present invention can achieve continuous heating during defrosting. By adopting optional heat storage units, not only can the internal space of the outdoor unit of the heat pump system be saved, but also the manufacturing and installation costs can be effectively reduced, and the design difficulty of the outdoor unit can be lowered.

BRIEF DESCRIPTION OF THE DRAWINGS

With reference to the accompanying drawings, the disclosure of the present application will become easier to understand. Those skilled in the art would readily appreciate that these drawings are for the purpose of illustration, and are not intended to limit the protection scope of the present application. In addition, in the FIGURES, similar numerals are used to denote similar components, where:

FIG. 1 shows a structural schematic diagram of an embodiment of a heat pump system according to the present invention.

DETAILED DESCRIPTION OF EMBODIMENT(S) OF THE INVENTION

A heat pump system according to an embodiment of the present invention will be described with reference to FIG. 1. The heat pump system according to the embodiment comprises an indoor unit and an outdoor unit communicated through a refrigerant pipeline, wherein the outdoor unit comprises a compressor 1, a first heat exchanger 2, a first throttling device 3, and a change-over valve 4, and the indoor unit comprises a second heat exchanger 5, and wherein the refrigerant pipeline has a refrigerant gas-phase pipeline and a refrigerant liquid-phase pipeline. The arrangement of the respective components in the outdoor unit and the indoor unit is the same as that of a conventional heat pump system and has the same function, which will not be repeated here. A heat storage unit P (see the rectangular dashed box in FIG. 1) is arranged on the refrigerant gas-phase pipeline between the indoor unit and the outdoor unit. The heat storage unit P includes a first branch L1 and a second branch L2 arranged in parallel, wherein the first branch L1 is provided with a heat storage heat exchanger 6 and a second throttling device 7, and the second branch L2 is provided with a control valve device 8 capable of cutting off refrigerant flowing through the second branch L2 in a controlled manner.

The heat pump system according to an embodiment of the present invention can operate in a cooling mode, a heating mode, a heat storage and heating mode, and a defrosting mode.

In the cooling mode, the second throttling device 7 is turned off, so that no refrigerant passes through the heat storage heat exchanger 6, and the control valve device 8 is turned on, so that refrigerant flows from the second heat exchanger 5 of the indoor unit to the change-over valve 4 of the outdoor unit through the second branch L2, and then enters the suction port of compressor 1. Specifically, in the cooling mode, the change-over valve 4 is configured so that port c is communicated with port a, and port d is communicated with port b. High-pressure refrigerant flowing out of the outlet of compressor 1 enters the change-over valve 4 through port c of the change-over valve 4 and leaves the change-over valve 4 through port a. After passing through the first heat exchanger 2 of the outdoor unit, which serves as a condenser, the high-pressure refrigerant is throttled by the first throttling device 3 to become low-pressure refrigerant. After passing through the second heat exchanger 5 of the indoor unit, which serves as an evaporator, the low-pressure refrigerant then passes through the second branch L2 of the heat storage unit P, enters the change-over valve 4 through port d of the change-over valve 4, leaves the change-over valve 4 through port b, and then returns to the inlet of compressor 1.

In the heating mode, the second throttling device 7 is turned on with a tiny opening to allow a small amount of refrigerant to flow through the heat storage heat exchanger 6 to maintain a flowing state, thereby avoiding the accumulation of liquid and oil in the heat storage heat exchanger 6. Therefore, the term "tiny opening" herein refers to the opening at which a small amount of refrigerant flows through the heat storage heat exchanger 6 to maintain its flowing state. At this point, the control valve device 8 is turned on to allow the refrigerant to flow from the change-over valve 4 of the outdoor unit to the second heat exchanger 5 of the indoor unit through the second branch L2. Specifically, in the heating mode, the change-over valve 4 is configured so that port a is communicated with port b, and port c is communicated with port d. The high-pressure refrigerant flowing out of the outlet of compressor 1 enters the change-over valve 4 through port c of the change-over valve 4 and leaves the change-over valve 4 through port d. After passing through the second branch L2 of the heat storage unit P, the high-pressure refrigerant enters the second heat exchanger 5 of the indoor unit, which serves as a condenser, and is then throttled by the first throttling device 3 to become low-pressure refrigerant. The low-pressure refrigerant passes through the first heat exchanger 2 of the outdoor unit, which serves as an evaporator, and then enters the change-over valve 4 through port a of the change-over valve 4 and leaves the change-over valve 4 through port b to return to the inlet of compressor 1.

In the heat storage and heating mode, the second throttling device 7 is fully turned on with the first throttling device 3 playing a throttling role, so that the heat storage heat exchanger 6 stores partial heat, causing the refrigerant to flow from the change-over valve 4 of the outdoor unit to the second heat exchanger 5 of the indoor unit through the first branch L1, and the control valve device 8 is turned off, so that no refrigerant passes through the second branch L2. Specifically, in the heat storage and heating mode, the change-over valve 4 is configured so that port a is communicated with port b, and port c is communicated with port d. High-pressure refrigerant flowing out of the outlet of compressor 1 enters the change-over valve 4 through port c of the change-over valve 4 and leaves the change-over valve 4 through port d, and passes through the heat storage heat exchanger 6 and the second throttling device 7 on the first branch L1 of the heat storage unit P for heat storage. And then, the high-pressure refrigerant enters the second heat exchanger 5 of the indoor unit, which serves as a condenser, and is then throttled by the first throttling device 3 to become low-pressure refrigerant. The low-pressure refrigerant passes through the first heat exchanger 2 of the outdoor unit, which serves as an evaporator, enters the change-over valve 4 through port a of the change-over valve 4 and leaves the change-over valve 4 through port b, and returns to the inlet of compressor 1. Of course, in order to avoid the impact of heat storage on indoor comfort and to extend the heat storage time, the second throttling device 7 can also be turned on with an appropriate opening for heat storage. Specifically, in the heat storage and heating mode, the second throttling device 7 is partially turned on to allow at least a portion of the refrigerant to flow through the heat storage heat exchanger 6 for slow heat storage, while the control valve device 8 is turned on to allow most of the refrigerant to pass through the second branch L2. Therefore, the heat pump system according to the present invention can store heat during heating.

In the defrosting mode, the first throttling device 3 is fully turned on with the second throttling device 7 playing a throttling role, so that the refrigerant flows through the heat storage heat exchanger 6 to absorb heat for evaporation, causing the refrigerant to flow from the second heat exchanger 5 of the indoor unit to the suction port of compressor 1 of the outdoor unit through the first branch L1, and the control valve device 8 is turned off, so that no refrigerant passes through the second branch L2. Specifically, in the defrosting mode, the change-over valve 4 is configured so that port c is communicated with port a, and port d is communicated with to port b. High-pressure refrigerant flowing out of the outlet of compressor 1 enters change-over valve 4 through port c of the change-over valve 4 and leaves the change-over valve 4 through port a before entering the first heat exchanger 2 of the outdoor unit, which serves as a condenser, thereby defrosting the condenser. Subsequently, the high-pressure refrigerant passes through the first throttling device 3 that is fully turned on from the first heat exchanger 2, and enters the second heat exchanger 5 of the indoor unit to continue providing heat to the indoor room. And then, the refrigerant sequentially passes through the second throttling device 7 and the heat storage heat exchanger 6 on the second branch L2 of the heat storage unit P, and is throttled by the second throttling device 7 to become low-pressure refrigerant. At this point, the low-pressure refrigerant absorbs heat and evaporates into a gaseous refrigerant in the heat storage heat exchanger 6. Then, the low-pressure refrigerant enters change-over valve 4 through port d of the change-over valve 4 and leaves the change-over valve 4 through port b to return to the inlet of compressor 1. Therefore, the heat pump system according to the present invention can achieve continuous heating during defrosting.

It can be seen from the above that the heat pump system according to the present invention adopts optional heat storage units, which can be detachably installed on the refrigerant gas-phase pipeline between the outdoor unit and the indoor unit as needed without changing the main components of the existing heat pump systems. This not only saves the internal space of the outdoor unit of the heat pump system and effectively reduces manufacturing and installation costs, but also lowers the design difficulty of the outdoor unit.

In some embodiments, the heat storage unit P can be detachably installed on the refrigerant gas-phase pipeline between the indoor unit and the outdoor unit. For example, the workers can cut the refrigerant gas-phase pipeline between the indoor unit and the outdoor unit to connect and install the heat storage unit P, without affecting the components of the outdoor unit and the indoor unit. Furthermore, the heat storage unit P is arranged on the refrigerant gas-phase pipeline between the second heat exchanger 5 and the change-over valve 4, as shown in FIG. 1.

In some embodiments, the control valve device 8 comprises a first solenoid valve and a second solenoid valve connected in series, where the first solenoid valve and the second solenoid valve cut off the refrigerant passing through the second branch in opposite directions. Wherein, the first solenoid valve and the second solenoid valve are turned on in the cooling mode and the heating mode, are turned off in the defrosting mode, and can be turned on or off as needed in the heat storage and heating mode.

In some embodiments, the control valve device can also be in the form of a bidirectional cutoff solenoid valve or an electric ball valve, which is turned on in the cooling mode and the heating mode, is turned off in the defrosting mode, and can be turned on or off as needed in the heat storage and heating mode.

In some embodiments, the heat storage heat exchanger 6 can be a phase change heat exchanger, which includes phase change materials to store thermal energy.

In some embodiments, the first throttling device 3 and the second throttling device 7 are electronic expansion valves.

According to another aspect, embodiments of the present invention further provide a control method for a heat pump system, the heat pump system comprising an indoor unit and an outdoor unit communicated through a refrigerant pipeline, wherein the outdoor unit comprises a compressor 1, a first heat exchanger 2, a first throttling device 3, and a change-over valve 4, and the indoor unit comprises a second heat exchanger 5, and wherein the refrigerant pipeline has a refrigerant gas-phase pipeline and a refrigerant liquid-phase pipeline. A heat storage unit P is arranged on the refrigerant gas-phase pipeline between the indoor unit and the outdoor unit, the heat storage unit P comprising a first branch L1 and a second branch L2 arranged in parallel, wherein the first branch L1 is provided with a heat storage heat exchanger 6 and a second throttling device 7, and the second branch L2 is provided with a control valve device 8 capable of cutting off refrigerant flowing through the second branch L2 in a controlled manner, turning off the second throttling device 7 in a cooling mode, so that no refrigerant passes through the heat storage heat exchanger 6, and turning on the control valve device 8 to allow the refrigerant to flow from the second heat exchanger 5 of the indoor unit to the change-over valve 4 of the outdoor unit through the second branch L2, and then enter a suction port of compressor 1;

turning on the second throttling device 7 with a tiny opening in a heating mode to allow a small amount of refrigerant to flow through the heat storage heat exchanger 6 to maintain its flowing state so as to avoid accumulation of liquid and oil, and turning on the control valve device 8 to allow the refrigerant to flow from the change-over valve 4 of the outdoor unit to the second heat exchanger 5 of the indoor unit through the second branch L2;

fully turning on the second throttling device 7 with the first throttling device 3 playing a throttling role in a heat storage and heating mode to store heat in the heat storage heat exchanger 6, and turning off the control valve device 8, so that no refrigerant passes through the second branch L2; or partially turning on the second throttling device 7 to allow at least a portion of the refrigerant to flow through the heat storage exchanger 6, and turning on the control valve device 8 to allow most of the refrigerant to pass through the second branch L2; and fully turning on the first throttling device 3 with the second throttling device 7 playing a throttling role in a defrosting mode to allow refrigerant to flow through the heat storage heat exchanger 6 to absorb heat for evaporation, and turning off the control valve device 8 so that no refrigerant passes through the second branch L2.

In some embodiments, the heat storage unit 6 can be detachably installed on the refrigerant gas-phase pipeline between the indoor unit and the outdoor unit.

In some embodiments, the method further includes connecting the first branch L1 and the second branch L2 in parallel on the refrigerant gas-phase pipeline between the change-over valve 4 and the second heat exchanger 5.

The specific embodiments of the present invention described above are merely for a clearer description of the principles of the present invention, in which individual components are clearly shown or described to make the principles of the present invention easier to understand. Various modifications or changes to the present invention may be easily made by those skilled in the art without departing from the scope of the present invention. It should therefore be understood that these modifications or changes shall be included within the scope of the patent protection of the present invention.

What is claimed is:

1. A heat pump system, comprising:

an outdoor unit comprising a compressor, a first heat exchanger, a first throttling device, and a change-over valve;

an indoor unit comprising a second heat exchanger;

a refrigerant pipeline comprising a refrigerant gas-phase pipeline and a refrigerant liquid-phase pipeline;

a heat storage unit comprising a first branch and a second branch, wherein the first branch is provided with a heat storage heat exchanger and a second throttling device, and the second branch is provided with a control valve device capable of cutting off refrigerant flowing through the second branch in a controlled manner; and wherein, the heat pump system is capable of operating in a heating mode, wherein in the heating mode, the second throttling device is turned on with an opening, and the control valve device is turned on to allow the refrigerant to flow from the change-over valve of the outdoor unit to the second heat exchanger of the indoor unit through the second branch.

2. The heat pump system according to claim 1, wherein the heat storage unit is arranged on the refrigerant gas-phase pipeline.

3. The heat pump system according to claim 1, wherein the first branch and the second branch are arranged in parallel.

4. The heat pump system according to claim 1, wherein the heat pump system is capable of further operating in a cooling mode, a heat storage and heating mode, and/or a defrosting mode.

5. The heat pump system according to claim 1, wherein the control valve device comprises a solenoid valve or an electric ball valve.

6. The heat pump system according to claim 1, wherein the heat storage heat exchanger is a phase change heat exchanger.

7. A heat pump system, comprising:

an outdoor unit comprising a compressor, a first heat exchanger, a first throttling device, and a change-over valve;

an indoor unit comprising a second heat exchanger;

a refrigerant pipeline comprising a refrigerant gas-phase pipeline and a refrigerant liquid-phase pipeline;

a heat storage unit comprising a first branch and a second branch, wherein the first branch is provided with a heat storage heat exchanger and a second throttling device, and the second branch is provided with a control valve device capable of cutting off refrigerant flowing through the second branch in a controlled manner; and wherein, the heat pump system is capable of operating in a heat storage and heating mode, wherein in the heat storage and heating mode, the second throttling device is fully turned on with the first throttling device playing a throttling role to store heat in the heat storage heat exchanger, and the control valve device is turned off, so that no refrigerant passes through the second branch.

8. The heat pump system according to claim 7, wherein, the heat pump system is capable of further operating in a heating mode, a cooling mode, and/or a defrosting mode.

9. The heat pump system according to claim 7, wherein the heat storage unit is arranged on the refrigerant gas-phase pipeline.

10. The heat pump system according to claim 7, wherein the first branch and the second branch are arranged in parallel.

11. The heat pump system according to claim 7, wherein the control valve device comprises a solenoid valve or an electric ball valve.

12. The heat pump system according to claim 7, wherein the heat storage heat exchanger is a phase change heat exchanger.

13. A heat pump system, comprising:

an outdoor unit comprising a compressor, a first heat exchanger, a first throttling device, and a change-over valve;

an indoor unit comprising a second heat exchanger;

a refrigerant pipeline comprising a refrigerant gas-phase pipeline and a refrigerant liquid-phase pipeline;

a heat storage unit comprising a first branch and a second branch, wherein the first branch is provided with a heat storage heat exchanger and a second throttling device, and the second branch is provided with a control valve device capable of cutting off refrigerant flowing through the second branch in a controlled manner; and wherein, the heat pump system is capable of operating in a heat storage and heating mode, wherein in the heat storage and heating mode, the second throttling device is partially turned on to allow at least a portion of the refrigerant to flow through the heat storage heat exchanger, and the control valve device is turned on to allow most of the refrigerant to pass through the second branch.

14. The heat pump system according to claim 13, wherein, the heat pump system is capable of further operating in a heating mode, a cooling mode, and/or a defrosting mode.

15. The heat pump system according to claim 13, wherein the heat storage unit is arranged on the refrigerant gas-phase pipeline.

16. The heat pump system according to claim 13, wherein the first branch and the second branch are arranged in parallel.

17. The heat pump system according to claim 13, wherein the control valve device comprises a solenoid valve or an electric ball valve.

18. The heat pump system according to claim 13, wherein the heat storage heat exchanger is a phase change heat exchanger.

* * * * *